US007481600B2

(12) United States Patent
Barton

(10) Patent No.: US 7,481,600 B2
(45) Date of Patent: Jan. 27, 2009

(54) ENERGY ABSORBING WALL SYSTEM AND METHOD OF USE

(76) Inventor: Douglas Barton, 610 N. Vine St., Fairmount, IN (US) 46928

( * ) Notice: Subject to any disclaimer, the term of this patent is extended or adjusted under 35 U.S.C. 154(b) by 0 days.

(21) Appl. No.: 11/807,864

(22) Filed: May 30, 2007

(65) Prior Publication Data

US 2007/0235706 A1 Oct. 11, 2007

Related U.S. Application Data

(63) Continuation of application No. 10/634,178, filed on Aug. 5, 2003, now abandoned.

(51) Int. Cl.
*E01F 13/10* (2006.01)
*E01F 13/04* (2006.01)

(52) U.S. Cl. ..... 404/10; 404/6; 404/9; 256/13.1; 52/174

(58) Field of Classification Search ..... 52/174, 52/144, 145; 404/6, 10, 7, 9; 256/1, 13.1
See application file for complete search history.

(56) References Cited

U.S. PATENT DOCUMENTS 3,674,115 A * 7/1972 Young et al. ..... 404/6
6,533,495 B1 * 3/2003 Williams et al. ..... 404/6

* cited by examiner

*Primary Examiner*—Phi Dieu Tran A
(74) *Attorney, Agent, or Firm*—Woodard, Emhardt, Moriarty, McNett & Henry LLP

(57) ABSTRACT

Provided is an energy-absorbing wall system for use with vehicle barriers, such as race track walls or barriers, highway guard rails or partitions, and the like. The wall system comprises a series of impact panels attachable to a wall and crush panels between the impact panels and the wall. The overlapping impact panels of the present system distribute collision energy from the impacted panels to crush panels and distally adjacent impact panels and crush panels, until the collision energy has been substantially distributed along the energy-absorbing wall system.

4 Claims, 8 Drawing Sheets

ENERGY ABSORBING WALL SYSTEM AND METHOD OF USE

This application is a continuation of U.S. patent application Ser. No. 10/634,178, filed Aug. 5, 2003 now abandoned which is hereby incorporated by reference.

FIELD OF THE INVENTION

The invention is directed generally the an energy absorbing wall system, and more particularly to a wall system for absorbing a portion of the energy of a collision between a vehicle and a wall.

BACKGROUND OF THE INVENTION

Various systems have been implemented to protect vehicle drivers from the impact energy associated with a vehicle colliding with a wall. Vehicles have been designed to deform on impact, thus absorbing energy. Seat belts have been designed to stretch, absorbing energy. In the field of auto racing, attempts have been made to cushion the walls or barriers surrounding the race track, for instance by placing stacks of tires along the walls. Though tires or similar cushions reduce the deceleration of a vehicle colliding with a wall, such systems do little to dissipate or absorb the energy of the collision. Instead, such systems reflect the collision energy back into the vehicle, and thus into the driver.

Energy-absorbing cushions have recently been introduced for use on race track walls or barriers. However, these energy-absorbing cushions are bulky and occupy valuable track space, effectively narrowing the race track. Further, when a vehicle collides with such a bulky cushion, the vehicle may tend to sink partially into the cushion, thereby tending to trap the vehicle and increase the impact force. Additionally, such energy-absorbing wall cushions tend to be expensive, and are difficult and/or time-consuming to replace after a collision.

What is needed in the art is an effective, yet simple and inexpensive energy absorbing wall system that mitigates the problems associated with present wall cushion systems.

SUMMARY OF THE INVENTION

Provided is an energy-absorbing wall system for use with vehicle barriers, such as race track walls or barriers, highway guard rails or partitions, and the like. The energy-absorbing wall system of the present invention is effective, compact, simple, inexpensive, and easy to replace. The wall system comprises a series of overlapping impact panels attachable to a wall, with energy absorbing crush panels between the impact panels and the wall.

In one embodiment, an impact panel defines three conceptually identifiable plates each having proximal and distal portions. For purposes of this disclosure the "proximal" direction is toward an on-coming vehicle, while the "distal" direction is the direction the vehicle is traveling. The first plate extends distally along, and attached to, the wall, the distal portion of the first plate transitioning into the proximal portion of the second plate. The second plate extends distally and away from the wall, the distal portion of the second plate transitioning into the proximal portion of the third plate. The third plate extends distally and substantially parallel to the wall, the distal portion of the third plate overlapping the proximal portion of the third plate of a distally adjacent impact panel. The overlapping impact panels define voids therebetween, and energy-absorbing crush panels are inserted into the voids. Optional lead and end impact panels are provided for the beginning and end of the wall system.

In operation the wall system absorbs energy by receiving an impact from a vehicle at one or more impact panels attached to a wall or barrier. The impacted impact panels deflect and/or deform, transferring at least a portion of the impact energy to the crush panels located between the impact panels and the wall. The crush panels deform plastically when sufficiently compressed between the impact panels and the wall, thereby absorbing collision energy.

Importantly, the overlapping impact panels of the present wall system distribute collision energy from the impacted impact panel and crush panel to distally adjacent impact panels and crush panels. For instance, in the embodiment described above, the distal portion of the third plate of the impacted panel overlaps, and thus contacts and transfers energy to, the proximal portion of the third plate of a distally adjacent impact panel. The distally adjacent impact panel then acts likewise on the next distally adjacent impact panel, and so on, until the collision energy has been substantially distributed along the energy-absorbing wall system.

By distributing the collision energy lengthwise down the wall, the present energy-absorbing wall system does not need to be thick and bulky, but rather is compact, requiring minimal track (or road) space. The wall system is simple and easy to repair, since it is comprised of individually removable pieces (the impact and crush panels). Finally, the system can be produced inexpensively out of readily available materials, such as steel sheet.

DETAILED DESCRIPTION OF PREFERRED EMBODIMENTS

Figure 1A:
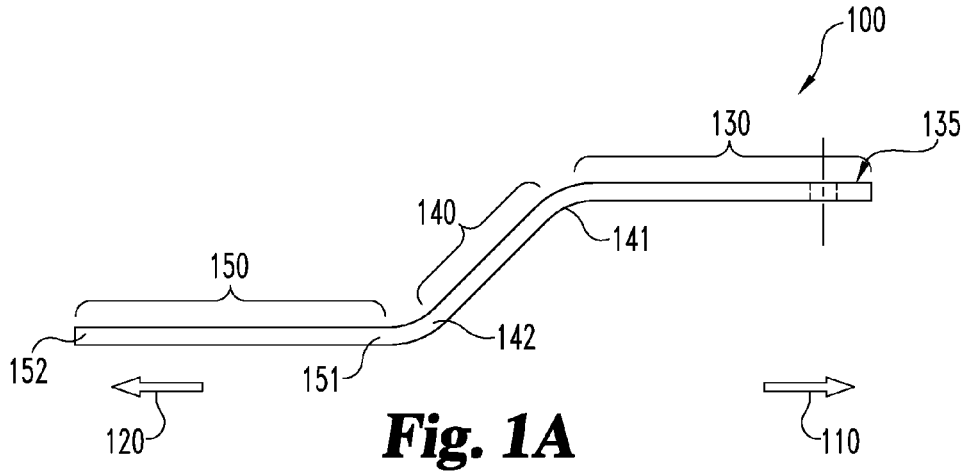
FIG. 1A is a top plan view of an impact panel according to one embodiment of the invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein, are herein contemplated as would normally occur to one skilled in the art to which the invention relates.

Figure 1B:
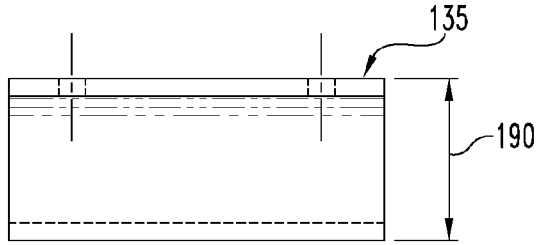
FIG. 1B is a right side view of the impact panel of FIG. 1A.
Figure 1C:
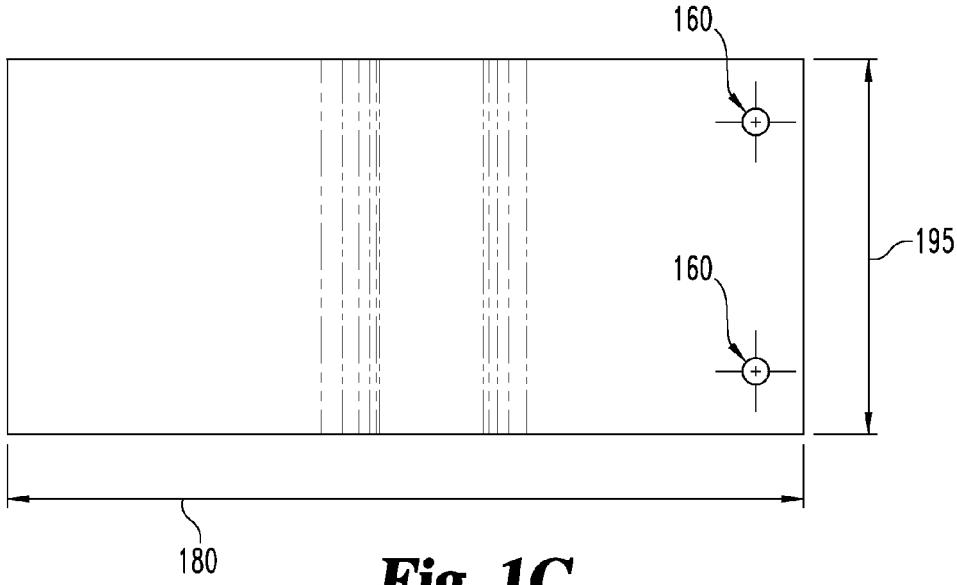
FIG. 1C is a front view of the impact panel of FIG. 1A.

Described below is the preferred embodiment of an energy-absorbing wall system for use with vehicle barriers, such as race track walls or barriers, highway guard rails or partitions, and the like. The wall system comprises a series of impact panels attachable to a wall. Referring to FIGS. 1A-1C, an impact panel 100 is shown according to one embodiment of the invention. Impact panel 100 defines three conceptually identifiable plates, 130, 140, 150, each having proximal and distal portions. For purposes of this disclosure the "proximal" direction is toward an on-coming vehicle, while the "distal" direction is the direction the vehicle is traveling, as depicted in FIG. 1A by arrows 110 (proximal direction) and 120 (distal direction).

In one embodiment of an impact panel 100, the first plate 130 defines a wall-adjacent surface 135, and extends distally 120, transitioning into the proximal portion 141 of the second plate 140. The second plate 140 extends distally 120 and away from wall-adjacent surface 135. The distal portion 142 of the second plate 140 transitions into the proximal portion 151 of the third plate 150. The third plate 150 extends distally 120 and substantially parallel to wall-adjacent surface 135, toward distal portion 152. Impact panel 100 may also comprise bolt holes 160.

Impact panel 100 may be formed from any material and in any geometry that combine to provide sufficient strength and flexibility when assembled in the wall system of the present invention. For instance, impact panel 100 may be formed from commercially-available half-inch thick hot rolled steel plate. Alternatively, aluminum, stainless steel or any other type of metal, plastics or composite materials of sufficient strength may be used.

Plates, 130, 140, and 150 are preferably formed from a single piece of material (e.g., steel plate), but may be individual pieces welded, fastened, or otherwise connected together. In one embodiment, the overall length 180 of impact panel 100 is approximately ten feet, the overall width 190 is eighteen inches, and the overall height 195 is four and one-half feet. The above materials and dimensions are for example only, as the present invention contemplates other materials and dimensions as would occur to one of skill in the art.

Figure 2A:
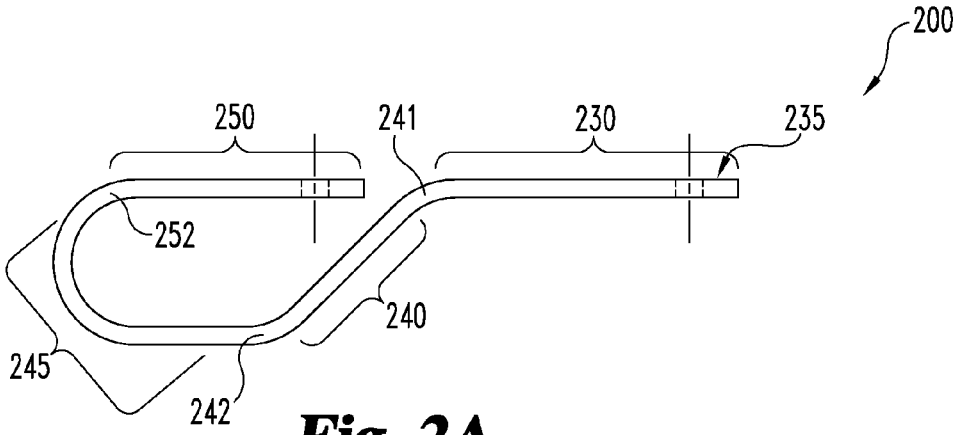
FIG. 2A is a top plan view of an end impact panel according to one embodiment of the invention.
Figure 2B:
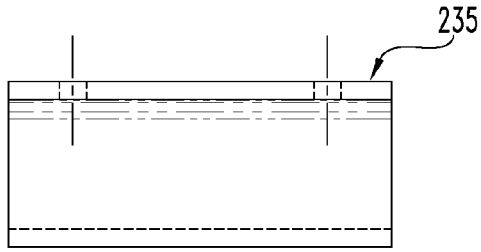
FIG. 2B is a right side view of the end impact panel of FIG. 2A.
Figure 2C:
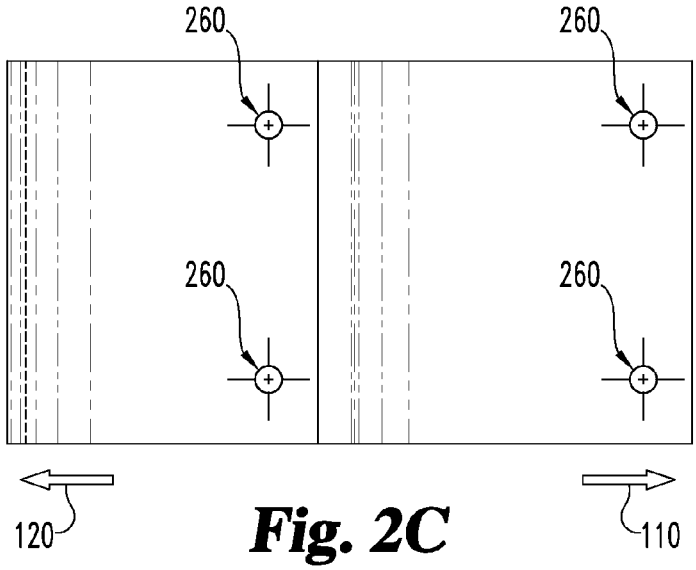
FIG. 2C is a back view of the end impact panel of FIG. 2A.

An optional end impact panel 200 ("end panel") is shown in FIGS. 2A-2C. In one embodiment, end panel 200 is attached to a wall (not shown) at the distal end of a series of impact panels 100 attached to the wall. End panel 200 defines three conceptually identifiable plates, 230, 240, 250, each having proximal and distal portions, with plate 240 transitioning into plate 250 through a turning portion 245.

In one embodiment of an end panel 200, the first plate 230 defines a wall-adjacent surface 235, and extends distally 120, transitioning into the proximal portion 241 of the second plate 240. The second plate 240 extends distally 120 and away from wall-adjacent surface 235. The distal portion 242 of the second plate 240 transitions into turning portion 245, which turns back toward wall-adjacent surface 235, and transitions into the distal portion 252 of the third plate 250. The third plate 250 extends proximally 110 and substantially coplanar with wall-adjacent surface 235. End panel 200 may also comprise bolt holes 260.

Figure 3A:
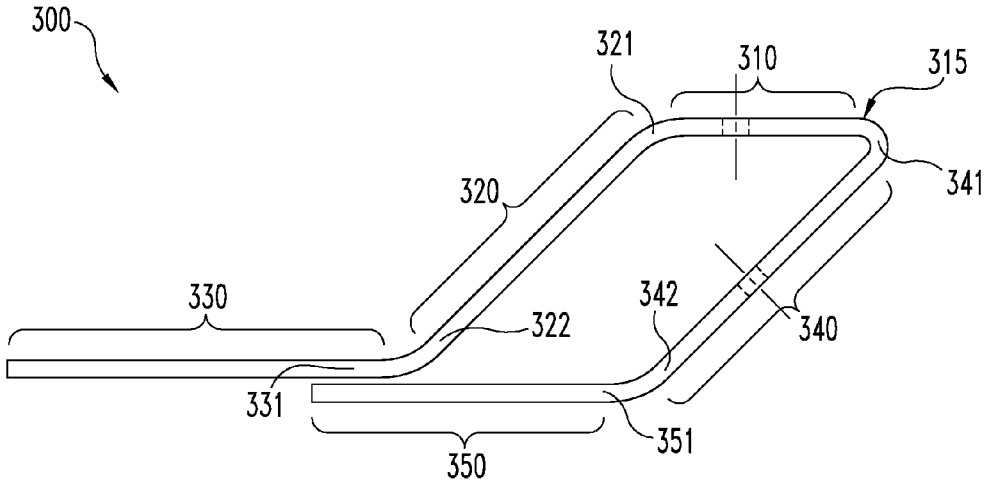
FIG. 3A is a top plan view of a lead impact panel according to one embodiment of the invention.
Figure 3B:
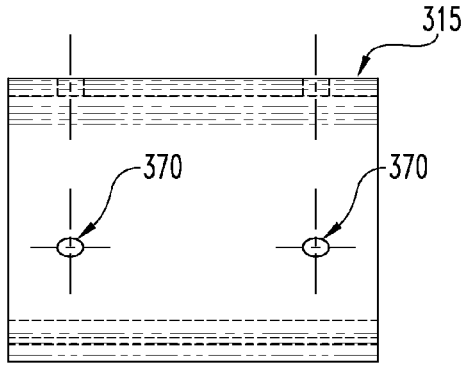
FIG. 3B is a right side view of the lead impact panel of FIG. 3A.
Figure 3C:
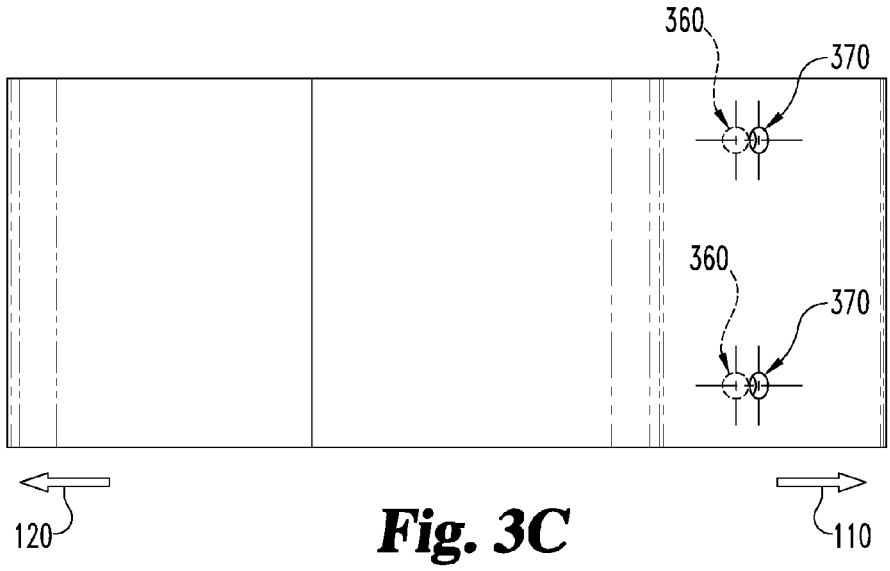
FIG. 3C is a front view of the lead impact panel of FIG. 3A.

An optional lead impact panel 300 ("lead panel") is shown in FIGS. 3A-3C. In one embodiment, lead panel 300 is attached to a wall (not shown) at the proximal end of a series of impact panels 100 attached to the wall. Lead panel 300 defines five conceptually identifiable plates, 310, 320, 330, 340, 350, each having proximal and distal portions.

In one embodiment of a lead panel 300, the first plate 310 defines a wall-adjacent surface 315, and extends distally 120, transitioning into the proximal portion 321 of the second plate 320. The second plate 320 extends distally 120 and away from wall-adjacent surface 315. The distal portion 322 of the second plate 320 transitions into the proximal portion 331 of the third plate 330. The third plate 330 extends distally 120 and substantially parallel with wall-adjacent surface 315. Returning once again to the first plate 310, it extends proximally 110, transitioning into the proximal portion 341 of the fourth plate 340. The fourth plate 340 extends distally 120 and away from wall-adjacent surface 315. The distal portion 342 of the fourth plate 340 transitions into the proximal portion 351 of the fifth plate 350. The fifth plate 350 extends distally 120 and substantially parallel with wall-adjacent surface 315, until it is adjacent and at least partially overlapping the proximal portion 331 of the third plate 330. Lead panel 300 may also comprise bolt holes 360 and access holes 370.

Both end panel 200 and lead panel 300 may be formed from any material and in any geometry that combine to provide sufficient strength and flexibility when assembled in the wall system of the present invention. For instance, either may be formed from the same materials as impact panel 100. In one embodiment, both the end panel 200 and lead panel 300 share the same height and width dimensions as impact panel 100. However, as stated with regard to the impact panel 100, such materials and dimensions are only examples, and do not limit the invention.

Figure 4:
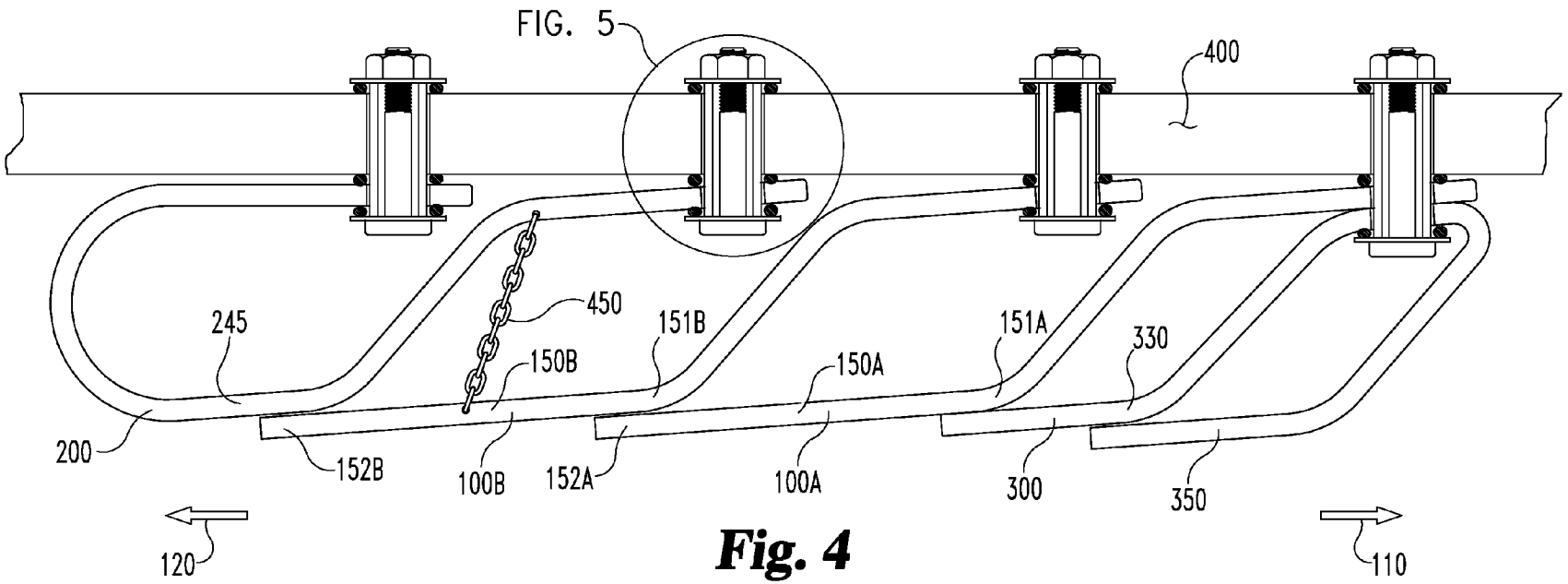
FIG. 4 is a top plan view of the impact panels of FIGS. 1-3, assembled to a wall.

FIG. 4 illustrates a series of impact panels 100 attached to a wall 400, with an optional lead impact panel 300 attached to the wall 400 at the beginning of the series, and an optional end impact panel 200 attached to the wall 400 at the end of the series. A series can comprise any number of impact panels 100, including one. The panels 100, 200, 300 overlap (at least upon deflection or deformation) to distribute collision energy from an impacted impact panel(s) to distally adjacent impact panels.

In the case of impact panel 100A, the distal portion 152A of the third plate 150A overlaps the proximal portion 151B of the third plate 150B of distally adjacent impact panel 100B. When sufficiently impacted (and thus deflected and/or deformed), impact panel 100A is capable of contacting and transferring energy to distally adjacent impact panel 100B, by pushing on the proximal portion 151B of the third plate 150B of distally adjacent impact panel 100B with the distal portion 152A of the third plate 150A of impact panel 100A. In one embodiment, the distal portion 152A of the third plate 150A of impact panel 100A overlaps the proximal portion 151B of the third plate 150B of distally adjacent impact panel 100B by approximately eight to ten inches.

Optional lead impact panel 300 functions similarly. Plate 350 overlaps, and thus is capable of transferring energy to, plate 330. Plate 330 of impact panel 300 correspondingly overlaps and can transfer energy to the proximal portion l51A of the third plate 150A of distally adjacent impact panel 100A.

Likewise, optional end impact panel 200 provides turning portion 245 to support and absorb energy from the distal portion 152B of the third plate 150B of proximally adjacent impact panel 100B.

According to one embodiment, each of the panels 100, 200, 300 is attached to the wall 400 with a fastener assembly 500. In one embodiment, there are two rows of fastener assemblies 500, with each fastener assembly 500 located distally five feet on-center from a proximally adjacent fastener assembly 500. Though fastener assemblies 500 are provided as one example of an attachment mechanism for panels 100, 200, 300, the invention is not limited to this example, but rather contemplates any other suitable attachment mechanism as would occur to one of skill in the art.

As shown in FIGS. 1-4, panels 100, 200, 300 may comprise bolt holes 160, 260, 360, respectively, to receive a fastener, such as a bolt. Panel 300 may also comprise access holes 370 to facilitate access to fasteners located at bolt holes 360. As shown in FIG. 4, an optional safety chain 450 or equivalent may link one or more panels 100, 200 or 300 with adjacent panels 100, 200 or 300.

Figure 5:
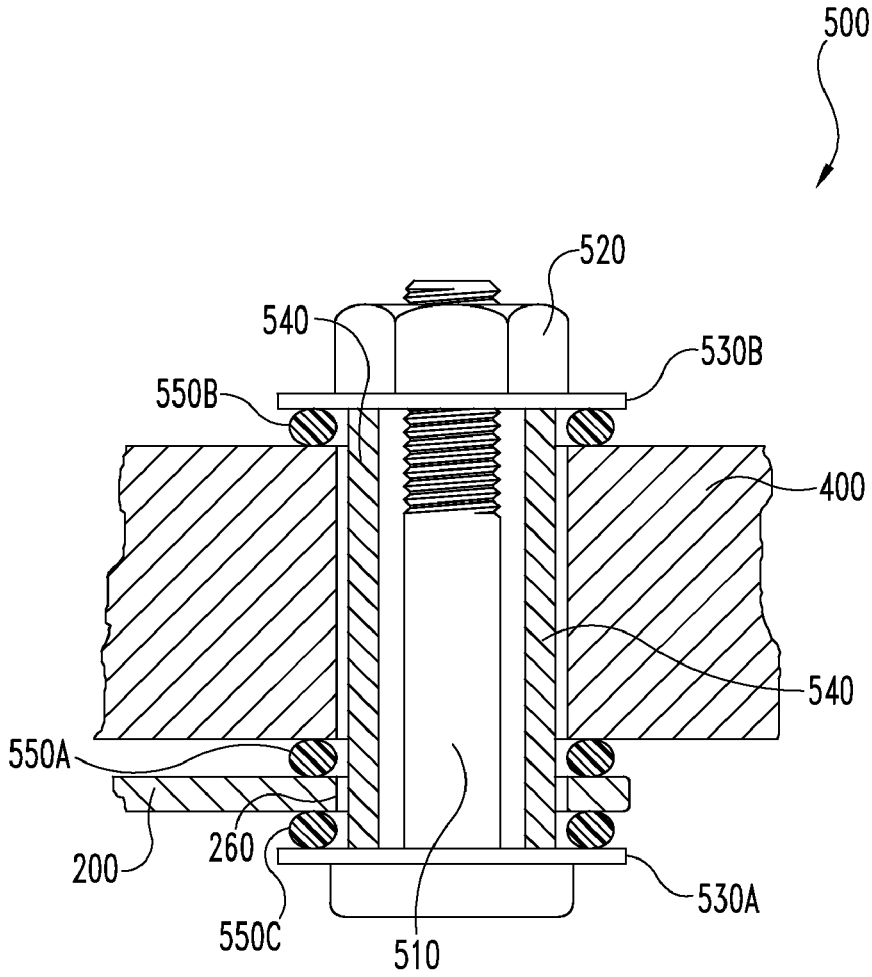
FIG. 5 is an enlarged section view of a fastening system for the assembly of FIG. 4, according to one embodiment of the invention.

FIG. 5 is a section view of exemplary fastener assembly 500. Fastener assembly 500 may include a fastener 510, nut 520, washers 530A, 530B, an annular member 540, and energy absorbing washers 550A, 550B, 550C for fastening a plate 100, 200 or 300 to a wall 400. The plates 100, 200, 300 are preferably at least partially mechanically isolated from the wall 400 by energy absorbing washers 550A, 550B, 550C to minimize shock to the wall 400 when plates 100, 200, 300 are impacted by a vehicle. Annular member 540 has an axial length greater than the thickness of the wall 400 by an amount necessary to facilitate the use of energy absorbing washers 550A, 550B and 550C, as shown in FIG. 5.

The assembly of a plate 100, 200 or 300 to a wall 400 using fastener assembly 500 will now be described. A washer 530A is assembled with fastener 510. Annular member 540 is assembled with fastener 510, so that fastener 510 extends through annular member 540. Energy absorbing washer 550C is assembled with fastener 510, around annular member 540. Fastener 510 is placed into a bolt hole 160, 260 or 360 in a plate 100, 200, or 300. Energy-absorbing washer 550A is assembled against the wall-adjacent surface 135, 235 or 335 of plate 100, 200 or 300, by placing the washer 550 over and around annular member 540.

The partially-assembled fastener assembly 500 is placed adjacent wall 400, and fastener 510 and annular member 540 are inserted into an appropriately sized hole in the wall 400. Energy-absorbing washer 550B is assembled against the side of the wall furthest from the panel 100, 200 or 300, by placing the washer 550B over and around the portion of annular member 540 extending through the wall 400. A second washer 530B and nut 520 are assembled with fastener 510, thereby clamping together washers 530A, 530B, panel 100, 200 or 300, and the annular member 540.

Because the axial length of the annular member 540 is sufficiently greater than the thickness of the wall 400, the clamped assembly does not directly clamp the panel 100, 200 or 300 to the wall 400. Instead, the axial gap created by the excess axial length of the annular member 540 beyond the thickness of the wall 400 is filled with the energy absorbing washers 550A, 550B, 550C. Thus, when appropriate dimensions are used, the only portions of fastener assembly 500 in contact with the wall 400 are the energy absorbing washers 550A, 550B, 550C, which at least partially mechanically isolate the plates 100, 200, 300 from the wall 400.

In one embodiment, fastener 510 is a round-head carriage bolt of sufficient size and strength to withstand the tensile and shear forces created by a vehicle impacting an impact plate 100, as one of skill in the art would calculate for a given geometry of impact plate 100. In one embodiment, energy absorbing washers 550A, 550B, 550C comprise polymeric washers or bushings, such as rubber or plastic. In another embodiment, energy absorbing washers 550A, 550B, 550C comprise springs. The annular member 540 may be formed from any sufficiently strong material in any appropriate geometry, such as cylindrical, hexagonal, or the like. In one embodiment, annular member 540 is formed from steel.

Figure 6:
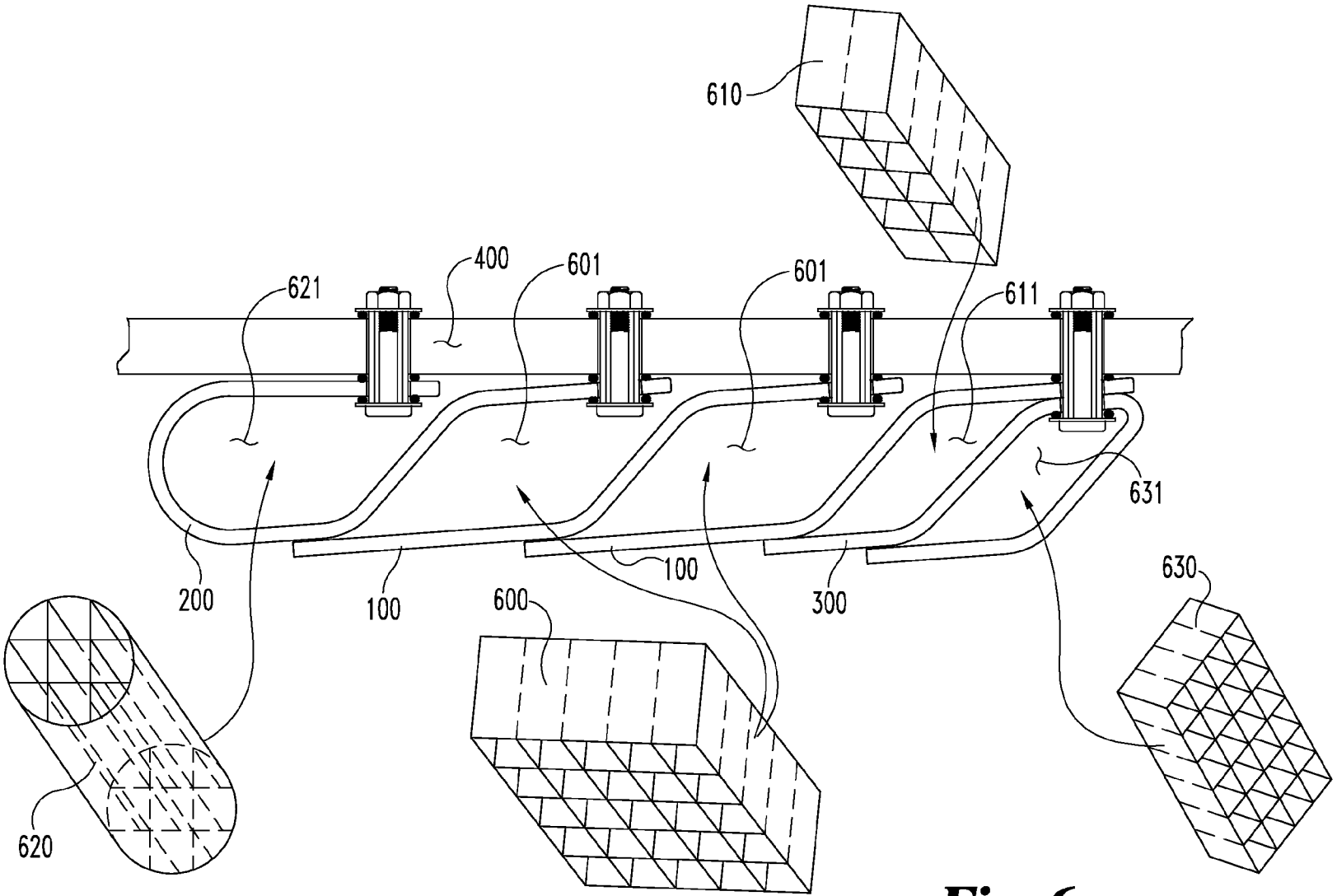
FIG. 6 is a top plan view of the assembly of FIG. 4, along with isometric views of crush panels according to one embodiment of the invention.

FIG. 6 shows a series of panels 100, 200, 300 attached to a wall 400, along with an example of energy-absorbing crush panels 600, 610, 620 and 630. The overlapping panels 100, 200, 300 define voids therebetween, and energy-absorbing crush panels 600, 610, 620 and 630 are inserted into the voids. Specifically, crush panel 600 is dimensionally adapted to fit within voids 601 created between adjacent impact panels 100. Crush panel 610 is dimensionally adapted to fit within the void 611 created between a lead impact panel 300 and an adjacent impact panel 100. Crush panel 620 is dimensionally adapted to fit within the void 621 created between the second plate 240, turning portion 245, and third plate 250 of the end impact panel 200. Crush panel 630 is dimensionally adapted to fit within the void 631 created between the first, second, fourth and fifth plates, 310, 320, 340 and 350, of the lead impact panel 300.

The crush panels shown in FIG. 6 are of a honeycomb design, and could be readily manufactured out of steel, for instance, using wall thicknesses of 1/64 to 3/16 inches. Alternatively, the crush panels shown in FIG. 6 could be manufactured from extruded aluminum, or from extruded or injected plastic. However, the crush panels shown in FIG. 6 are just one example of geometry that could be useful to absorb energy, and the invention is not limited to this example. A crush panel can comprise any combination of materials formed in any geometry that results in a crush panel that tends to absorb energy (e.g., by deforming plastically) when squeezed between plates 100, 200 or 300 and/or the wall 400, when a vehicle (not shown) collides with a plate 100, 200 or 300.

The crush panels 600, 610, 620 and 630 can be held in their respective voids by, for example, gravity, attachment to the wall 400 or one or more plates 100, 200, or 300, or by interference fitting the crush panels 600, 610, 620 and 630 in their respective voids. The crush panels 600, 610, 620 and 630 preferably substantially fill their respective voids in the direction perpendicular to the longitudinal axis of the wall 400, as shown in FIG. 7.

Figure 7:
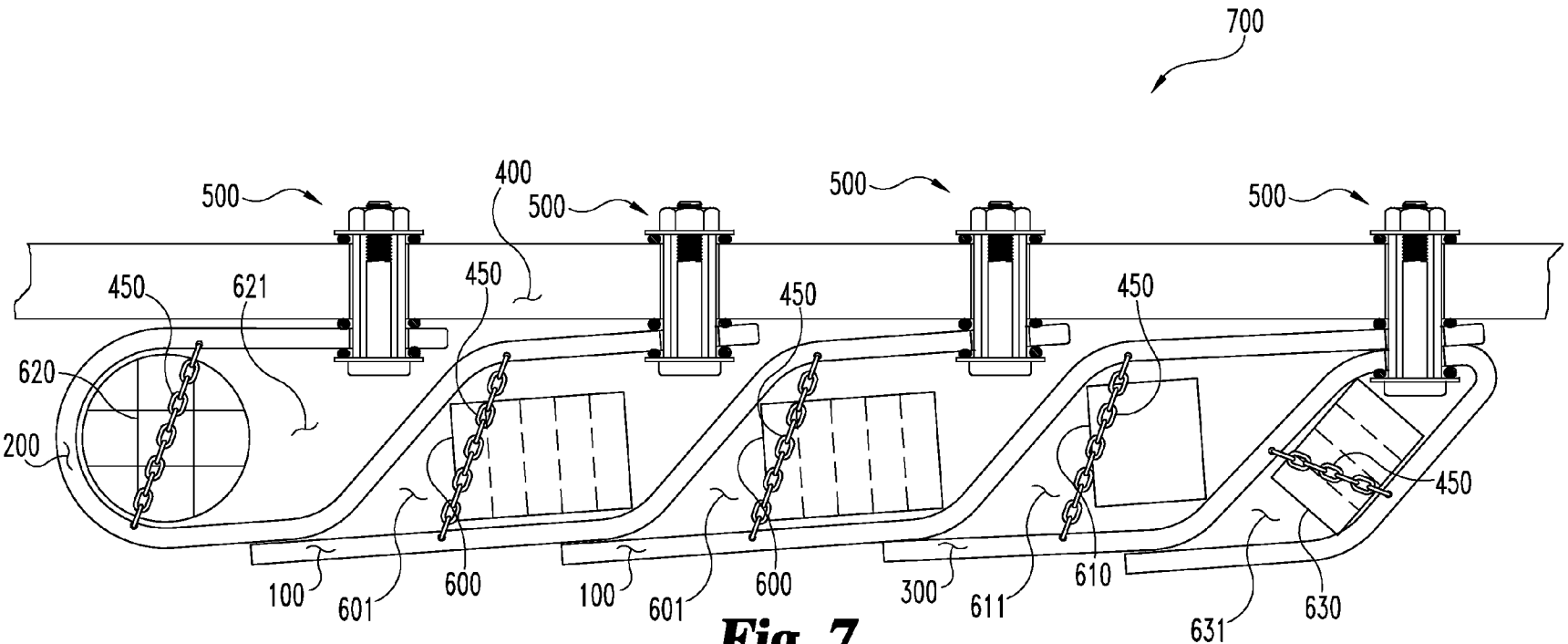
FIG. 7 is a top plan view of the assembly of FIG. 4, with the crush panels of FIG. 6 combined therewith according to one embodiment of the invention.
Figure 8:
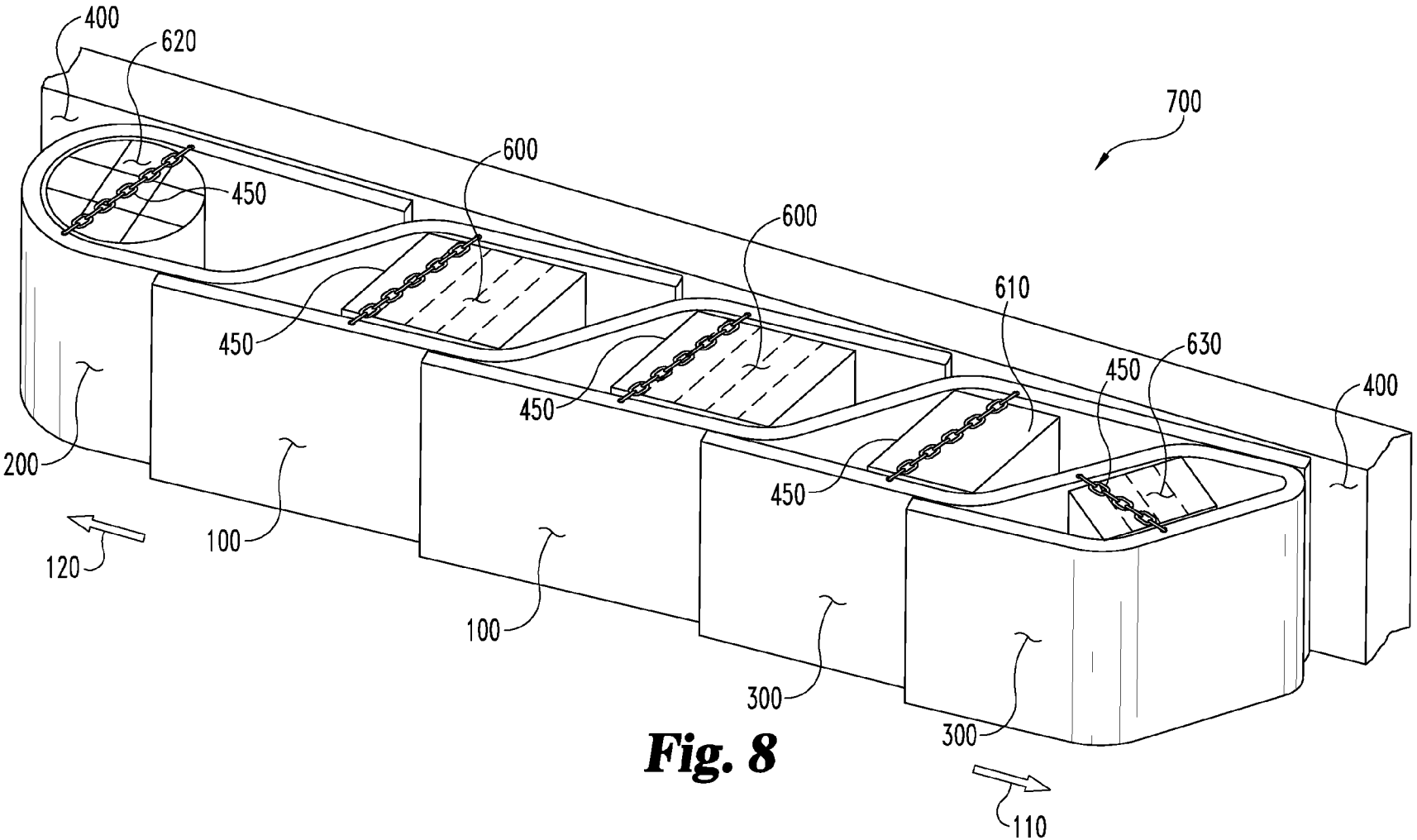
FIG. 8 is a perspective view of the assembly of FIG. 7, according to one embodiment of the invention.

FIGS. 7 and 8 illustrate one embodiment of a wall system 700, comprising impact panels 100, 200, 300, serially attached to a wall 400 with fastener assemblies 500, with crush panels 600, 610, 620 and 630 inserted into their respective voids 601, 611, 621 and 631. The wall system 700 can be made virtually any length by addition or removal of impact panels 100. Further, lead impact panel 300 and end impact panel 200 are optional.

In operation, a vehicle (not shown) begins to collide with one or more impact panels 100, 200 or 300. Upon collision, the vehicle begins to transfer at least a portion of its kinetic energy to the impacted panels 100, 200 or 300. Impacted panels 100, 200 or 300 deflect as the collision energy is transferred. As the impacted panels 100, 200 or 300 deflect, they begin to squeeze the crush panels 600, 610, 620 and 630 within their respective voids 601, 611, 621 and 631 behind said impacted panels 100, 200 or 300. If the collision transfers sufficient energy, the crush panels 600, 610, 620 and 630 behind said impacted panels 100, 200 or 300 begin to deform, absorbing energy.

As the crush panels 600, 610, 620 and 630 behind said impacted panels 100, 200 or 300 deform, the impacted panels 100 or 300 begin pushing on the portions of the distally adjacent impact panels 100 or 200 that impacted panels 100 or 300 overlap. Thus, the distally adjacent impact panels 100 or 200 also begin to deflect, and if sufficient unabsorbed collision energy remains, the distally adjacent impact panels 100 or 200 begin to deform the crush panels 600, 610 or 620 behind the distally adjacent impact panels 100 or 200. This process of transferring unabsorbed collision energy serially to adjacent impact panels 100, 200 (and corresponding crush panels) continues until the collision energy is substantially absorbed, or the wall system 700 ends.

While one embodiment of the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. Moreover, various details regarding the selection of materials and components, and fabrication and mounting of the wall system have been omitted, since such information would be known to one of ordinary skill in the art.

What is claimed is:

1. An energy-absorbing and vehicle directing barrier system, comprising:

a barrier located adjacent a vehicle path that extends parallel therewith;

a first impact panel with a first proximal end and a first distal end, said first proximal end is fixedly mounted directly to said barrier to be immovable when said first impact panel is impacted by a vehicle, said first impact panel further has a first flat, distal portion between said first proximal end and said first distal end that is parallel to said barrier; said first impact panel further has a first flat, proximal portion between said first proximal end and said first distal end that is positioned adjacent said barrier and extends along therewith, said first impact panel further has a first angular portion between said first proximal end and said first distal end that extends angularly outward from said barrier in a direction from said first proximal end to said first distal end, said first angular portion is angularly and integrally connected to said first flat, proximal portion and angularly and integrally connected to said first flat, distal portion;

a second impact panel with a second proximal end and a second distal end, said second proximal end is fixedly mounted directly to said barrier to be immovable when said second impact panel is impacted by a vehicle, said second impact panel further has a second flat, distal portion between said second proximal end and said second distal end that is parallel to said barrier, said second impact panel further has a second flat, proximal portion between said second proximal end and said second distal end that is positioned adjacent said barrier and extends along therewith, said second impact panel further has a second angular portion between said second proximal end and second distal end that extends angularly outward from said barrier in a direction from said second proximal end to said second distal end, said second angular portion is angularly and integrally connected to second flat, proximal portion and angularly and integrally connected to said second flat, distal portion, said second flat, distal portion is positioned adjacent and inwardly of said first distal end with said first distal end overlapping said second flat, distal portion and being unconnected thereto while being independently slidably movable relative to said second flat, distal portion and without being impeded in slidable movement in a direction parallel to said barrier by said second flat distal portion, said first flat, distal portion and said second flat, distal portion extending parallel with respect to each other and to said barrier directing a vehicle impacting said first impact panel and said second impact panel along an area extending across said first, flat distal portion and said second flat, distal portion in the direction of said vehicle path parallel to said barrier;

a first crushable member positioned between the first impact panel and the barrier, said first crushable member absorbing a portion of the collision energy of a vehicle impacting said first impact panel;

a second crushable member positioned between the second impact panel and the barrier to absorb a portion of collision energy of a vehicle impacting said first impact panel and said second impact panel and to direct a portion of collision energy along the length of the barrier system as the vehicle is directed by said first flat, distal portion and said second flat, distal portion parallel to said barrier;

said first distal end extends past said second angular portion in a direction from said first proximal end to said first distal end; and said first distal end extends past said first crushable member in said direction from said first proximal end to said first distal end.

2. The energy-absorbing barrier system of claim 1 wherein:

said first crushable member is dimensionally adapted to fit between the first fiat, distal portion and the second flat, proximal portion, and between the first angular portion and the second angular portion enclosing said first crushable member and separating said first crushable member from said barrier;

said second crushable member is dimensionally adapted to fit between said second flat, proximal portion and an adjacent impact panel enclosing said second crushable member and separating said second crushable member from said barrier;

said first flat, distal portion is adjacent to said first crushable member and outwardly adjacent to said second flat, distal portion to directly contact and deflect said first flat, distal portion against said first crushable member and the second flat, distal portion against said second crushable member upon vehicle impact of said first impact panel.

3. The barrier system of claim 2 and wherein:

the first flat proximal portion having one or more fastener holes for fastening the first impact panel to said barrier; and further comprising:

a pliant fastening system pliably fastening the first impact panel to said barrier, including pliable material adapted to be placed between the first impact panel and the barrier, and a fastener fastening the pliable material between the first impact panel and the barrier.

4. A method of absorbing impact energy from a vehicle, comprising the steps of:

providing an energy-absorbing and vehicle directing barrier system, including:

a barrier located adjacent a vehicle path that extends parallel therewith;

a first impact panel with a first proximal end and a first distal end, said first proximal end is fixedly mounted directly to said barrier to be immovable when said first impact panel is impacted by a vehicle, said first impact panel further has a first fiat, distal portion between said first proximal end and said first distal end that is parallel to said barrier; said first impact panel further has a first flat, proximal portion between said first proximal end and said first distal end that is positioned adjacent said barrier and extends along therewith, said first impact panel further has a first angular portion between said first proximal end and said first distal end that extends angularly outward from said barrier in a direction from said first proximal end to said first distal end, said first angular portion is angularly and integrally connected to said first flat, proximal portion and angularly and integrally connected to said first flat, distal portion;

a second impact panel with a second proximal end and a second distal end, said second proximal end is fixedly mounted directly to said barrier to be immovable when said second impact panel is impacted by a vehicle, said second impact panel further has a second flat, distal portion between said second proximal end and said second distal end that is parallel to said barrier, said second impact panel further has a second flat, proximal portion between said second proximal end and said second distal end that is positioned adjacent said barrier and extends along therewith, said second impact panel further has a second angular portion between said second proximal end and second distal end that extends angularly outward from said barrier in a direction from said second proximal end to said second distal end, said second angular portion is angularly and integrally connected to second flat, proximal portion and angularly and integrally connected to said second flat, distal portion, said second flat, distal portion is positioned adjacent and inwardly of said first distal end with said first distal end overlapping said second flat, distal portion and being unconnected thereto while being independently slidably movable relative to said second flat, distal portion, said first flat, distal portion and said second flat, distal portion extending parallel with respect to each other and to said barrier directing a vehicle impacting said first impact panel and said second impact panel along an area extending across said first, flat distal portion and said second flat, distal portion in the direction of said vehicle path parallel to said barrier;

a first crushable member positioned between the first impact panel and the barrier, said first crushable member absorbing a portion of the collision energy of a vehicle impacting said first impact panel;

a second crushable member positioned between the second impact panel and the barrier to absorb a portion of collision energy of a vehicle impacting said first impact panel and said second impact panel and to direct a portion of collision energy along the length of the barrier system as the vehicle is directed by said first flat, distal portion and said second flat, distal portion parallel to said barrier;

said first distal end extends past said second angular portion in a direction from said first proximal end to said first distal end; and said first distal end extends past said first crushable member in said direction from said first proximal end to said first distal end;

impacting said first flat, distal portion with a vehicle;

moving said first flat, distal portion against the first crushable device;

at least partially crushing said first crushable member;

slidably moving in a direction parallel to said barrier said first flat, distal portion against and outwardly of said second flat, distal portion without being impeded in slidable movement parallel to said barrier by said second flat distal portion;

at least partially crushing said second crushable member; and, directing said vehicle along an area extending across said first flat, distal portion and said second flat, distal portion in the direction of said barrier.

* * * * *